United States Patent [19]

Catena

[11] Patent Number: 4,715,288

[45] Date of Patent: Dec. 29, 1987

[54] APPARATUS FOR THE OVERHEAD TRANSPORTATION OF HEAVY LOADS ON A MONORAIL

[75] Inventor: Nicola Catena, Leumann, Italy

[73] Assignee: Fata European Group S.p.A., Turin, Italy

[21] Appl. No.: 857,181

[22] Filed: Apr. 29, 1986

[30] Foreign Application Priority Data

May 23, 1985 [IT] Italy ..... 21925/85[U]

[51] Int. Cl.[4] ..... B61B 3/02

[52] U.S. Cl. ..... 105/154; 104/95

[58] Field of Search ..... 104/93, 95, 94, 172.4, 104/91, 89; 105/153, 154, 156, 148; 403/157

[56] References Cited

U.S. PATENT DOCUMENTS

| | | | |
|---|---|---|---|
| 629,185 | 7/1899 | Arnold | 403/157 |
| 3,129,671 | 4/1964 | Vanderbeck | 105/153 |
| 3,349,719 | 10/1967 | Young | 104/91 |
| 3,568,605 | 3/1971 | Pettit | 104/95 |
| 3,758,941 | 9/1973 | Jackson et al. | 403/157 |
| 4,122,778 | 10/1978 | Di Rosa | 104/94 X |

FOREIGN PATENT DOCUMENTS

| | | | |
|---|---|---|---|
| 971900 | 7/1975 | Canada | 104/172 S |
| 3016454 | 11/1981 | Fed. Rep. of Germany | 104/91 |

*Primary Examiner*—Robert B. Reeves
*Assistant Examiner*—Thomas W. Kearns
*Attorney, Agent, or Firm*—Stevens, Davis, Miller & Mosher

[57] ABSTRACT

An apparatus for the overhead transportation of loads on a monorail, comprising in combination: a tractive trolley (1) connected in an articulated manner to at least one idle truck (11) consisting of a girder (23) carrying a load, the girder being restrained to bars (24) extending downwards from terminal trolleys (25, 26) to which the bars are pivoted.

7 Claims, 4 Drawing Figures

APPARATUS FOR THE OVERHEAD TRANSPORTATION OF HEAVY LOADS ON A MONORAIL

The present invention relates to an improved apparatus for overhead transportation of heavy loads on a monorail.

It is known to effect the overhead transportation of heavy loads on a monorail by means of a truck which consists structurally of a pair of terminal trolleys rigidly interconnected by a body to which the load is restrained. One of the terminal trolleys is powered, but if not provision can be made for a tractive means to be mounted in an intermediate position.

As well as being relatively costly to construct, an apparatus as described above has a use confined to level runs in that the rigidity of the structure does not permit it to cover ascending and/or descending runs. Additionally, the rigidity of the structure is not suited to adapt to variations in load conditions, both in point of weight and of bulk dimensions.

The overall object of the present invention is to obviate the aforesaid drawbacks by embodying a transportation apparatus of the type in question that will move both on level and sloping sections and be readily and quickly able to adapt to any variation in load conditions.

Another object of the invention is to embody an apparatus of small bulk.

To achieve these objects, the present invention embodies an apparatus for the overhead transportation of loads on a monorail, characterized in that it comprises, in combination: a tractive trolley (10) which is connected in an articulated manner to at least one idle truck (11) consisting of a girder (23) for suspending a load, which girder is restrained by bars (24) extending downwards from terminal trolleys (25, 26) to which the said bars are pivoted.

The structural and functional characteristics of the invention, and its advantages over the known art, will become more apparent from an examination of the following description, referred to the appended diagrammatic drawings, in which:

FIG. 1 shows the combination of two idle trucks to one of which a tractive means is connected in an articulated manner;

Figure 1:
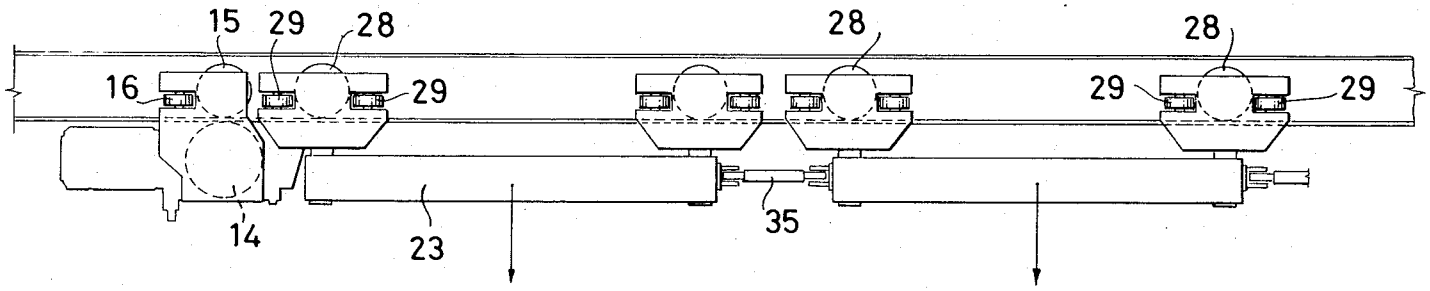
FIGS. 1 and 2 are two elevational views illustrating an embodiment of the invention, where
Figure 2:
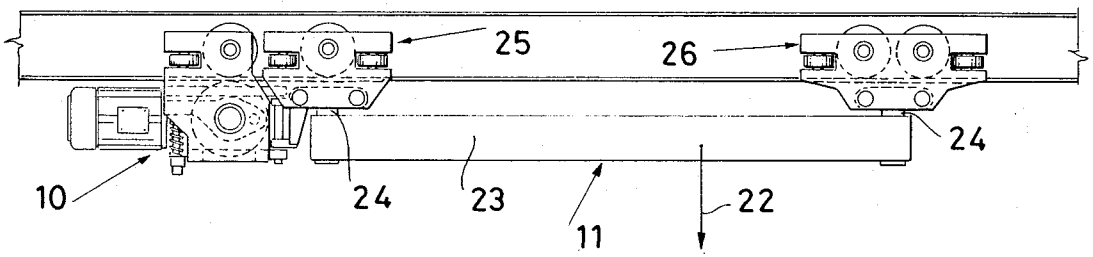

With reference to the drawings, the numeral 10 indicates overall a tractive trolley and the numeral 11 an idle truck, which are intended to move along an overhead line and more particularly an "I"-profiled monorail 12.

The tractive trolley 10 (FIGS. 3 and 4) consists structurally of a pair of sides 13 between which there are mounted, at a lower level, a drive wheel 14 and, at a higher level, wheels 15, 16, which are respectively a supporting wheel and a guide wheel. Through the intermediary of a pin 17, the wheel 14 is mounted on a fork 18 pivoted at 19 to the sides 13. A spring 20 thrusts the fork 18 in the direction of the arrow 21 so as to maintain the drive wheel 14 in permanent contact with the lower flange of the profile 12.

The idle truck 11, from which there is suspended a load to be transported indicated schematically by the arrow 22, is on the contrary structurally formed of a girder 23 restrained to bars 24 which extend downwards from terminal trolleys 25, 26, being front and rear trolleys respectively.

Each of trolleys 25, 26 consists of a pair of sides 27 between which there are mounted pairs of bearing wheels 28 and guide wheels 29.

The wheels 28, 29 rest respectively on the lower flange and on the web of the profile 12.

It should be noted that the tractive trolley 10 and the trolley 25 have a pair of guide wheels 29 in common, which fact is very advantageous both costwise and as regards reduction of longitudinal bulk when compared to known tractive means provided with two pairs of such wheels-which, moreover, are not adapted to take bends of relatively narrow radius.

Figure 3:
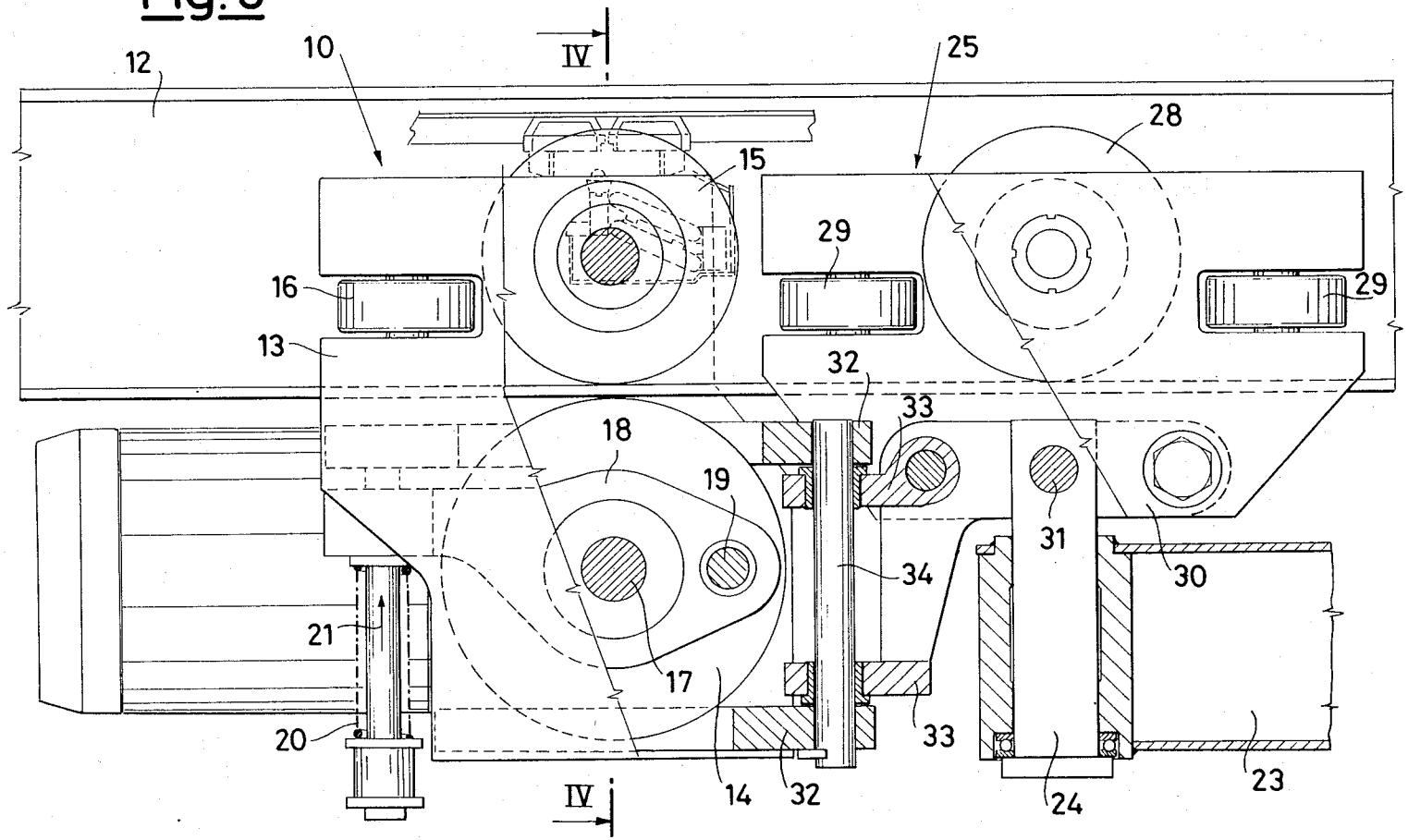
FIG. 3 is an enlarged particular showing in section of the articulated connection between the tractive means and the idle truck.
Figure 4:
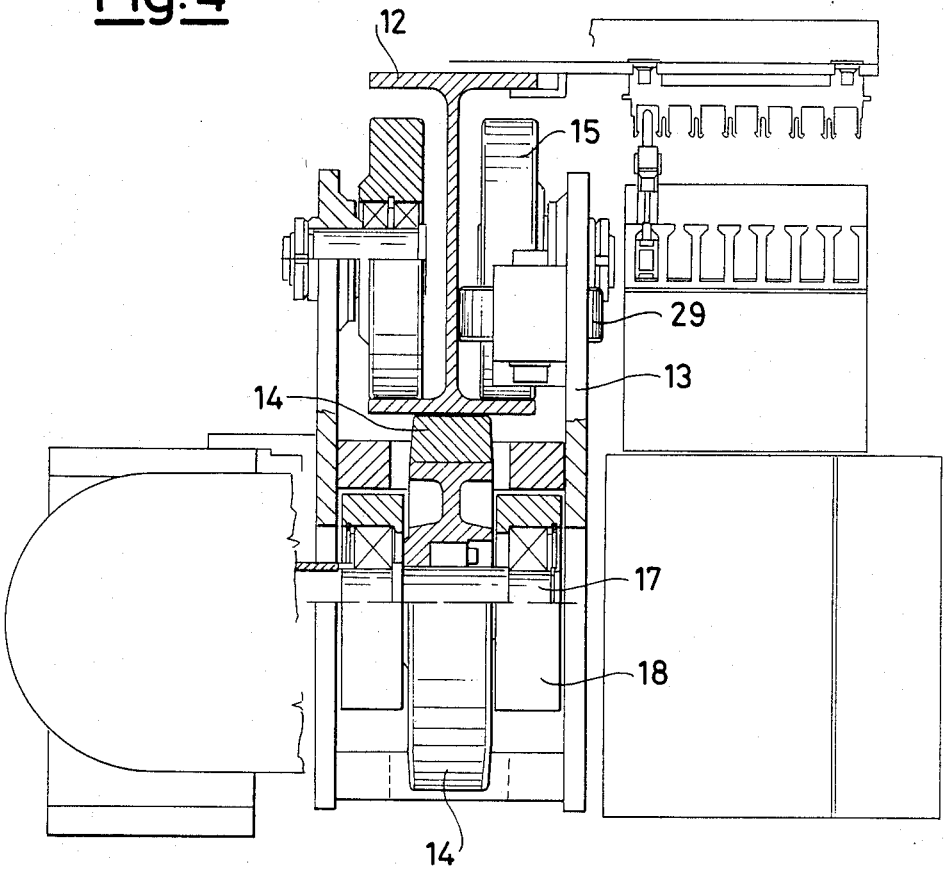
FIG. 4 is a sectional view taken through the line IV—IV of FIG. 3.

As is clearly seen from FIG. 3 of the drawings, between the sides 27 there is bolted a bracket 30 to which there is pivoted at 31 the aforesaid bar 24 to which the girder 23 is restrained.

The front trolley 25 is also connected to the tractive means 10 through the intermediary of an articulated joint consisting of a pair of forks 32, 33 pivotable relative to each other by a vertical pivot 34, the forks (32, 33) being fixed to the sides 13 and 27 respectively.

There is in this way embodied, between the tractive trolley 10 and truck 11, an articulation consisting of the pivot shaft 34, which assures freedom of relative movement between tractive trolley 10 and truck 11 in the horizontal translation plane. Sloping sections, however, can be mastered because of horizontal pivot shaft 31 permitting the pivoting of girder 23 relative to the terminal trolleys 25, 26.

As can be seen from FIG. 1, several trucks 11 can be interconnected through the intermediary of an articulated joint 35, to form a train.

The advantages of the embodiment heretofore described can be summarized as follows: the drive wheel of the tractive trolley 10 is never a bearing wheel and, moreover, even when moving through bends, it always moves substantially along the ideal line of translation, i.e. with its axis passing through the center of the curve. This movement is due to the fact that the axes of the pivot 34 and the pair of guide wheels 29, immediately above the pivot 34 lie in one and the same vertical plane. For such reasons, the wheel 14 can with advantage be constructed from resin.

The articulation pivot pin 34 is also itself an element of connection between the tractive trolley and the truck, and thus its length is appreciably less than that of conventional hook-up systems.

Another far from negligible advantage given by the apparatus embodied according to the invention is the fact that, with it, it is possible to transport loads which have a longitudinal development and thus very limited height.

I claim:

1. An apparatus for the overhead transportation of loads on a monorail comprising, at least one truck (11), a tractive trolley (10), a vertically positioned pivot pin (34) articulately connecting said truck (11) and said tractive trolley (10), said truck (11) comprising first and second terminal trolleys (25, 26), bars (24) pivotally extending downwardly from said first and second terminal trolleys (25, 26), a girder (23) having ends mounted on said first and second terminal trolleys (25,

26), and a first and second pair of guide wheels mounted on said first terminal trolley (25), a first fork (32) having a bifurcated section with aligned holes therethrough, said pivot pin (34) being mounted in said aligned holes, a second fork (33) having a bifurcated section with aligned holes therethrough, said pivot pin (34) passing through said aligned holes of said second fork (33), said first fork (32) being fixed to said tractive trolley (10), said second fork (33) being fixed to said first terminal trolley (25) and said pivot pin (34) and first pair of guide wheels having axes being positioned in the same vertical plane.

2. The apparatus of claim 1 wherein said tractive trolley comprises a pair of parallel sides (13), a rotatable drive wheel (14) pivotally mounted between said sides (13), a rotatable support wheel (15) mounted on the interior of each side (13) above said rotatable drive wheel (14), said rotatable support wheels being axially aligned and a pair of rotatable guide wheels (16) mounted on the interior of either side (13), said pair of rotatable guide wheels (16) having their axes parallelly mounted.

3. The apparatus of claim 2 wherein said drive wheel is made of resin.

4. The apparatus of claim 1 wherein said first and second terminal trolleys each comprise a pair of sides and a rotatable support wheel mounted on the interior of each side, said rotatable support wheels being axially aligned.

5. An apparatus for the overhead transportation of loads on a monorail comprising, at least one truck (11), a tractive trolley (10), a vertically positioned pivot pin (34) articulately connecting said truck (11) and said tractive trolley (10), said truck (11) comprising first and second terminal trolleys (25, 26), bars (24) pivotally extending downwardly from said first and second terminal trolleys (25, 26), a girder (23) having ends mounted on said first and second terminal trolleys (25, 26), and a first and second pair of guide wheels mounted on said first terminal trolley (25), a first fork (32) having a bifurcated section with aligned holes therethrough, said pivot pin (34) being mounted in said aligned holes, a second fork (33) having a bifurcated section with aligned holes therethrough, said pivot pin (34) passing through said aligned holes of said second fork (33), said first fork (32) being fixed to said tractive trolley (10), said second fork (33) being fixed to said first terminal trolley (25) and said pivot pin (34) and first pair of guide wheels having axes being positioned in the same vertical plane, said tractive trolley comprising a pair of parallel sides (13), a rotatable drive wheel (14) pivotally mounted between said sides (13), a rotatable support wheel (15) mounted on the interior of each side (13) above said rotatable drive wheel (14), said rotatable support wheels being axially aligned and a pair of rotatable guide wheels (16) mounted on the interior of either side (13), said pair of rotatable guide wheels (16) having their axes parallelly mounted, one of said pairs of rotatable guide wheels being mounted on said first terminal trolley acting as a second pair of rotatable guide wheels for said tractive trolley.

6. The apparatus of claim 5 wherein said first and second terminal trolleys each comprise a pair of sides and a rotatable support wheel mounted on the interior of each side, said rotatable support wheels being axially aligned.

7. The apparatus of claim 5 wherein said drive wheel is made of resin.

* * * * *